US005815788A

United States Patent [19]

In't Zandt

[11] Patent Number: 5,815,788

[45] Date of Patent: Sep. 29, 1998

[54] PRINTING APPARATUS FOR PRINTING TONER POWDER IMAGES ON BOTH SIDES OF AN IMAGE RECEIVING SUPPORT

[76] Inventor: Hubertus W. G. In't Zandt, Byronstraat 55, 5924 XL Venlo, Netherlands

[21] Appl. No.: 900,837

[22] Filed: Jul. 25, 1997

[30] Foreign Application Priority Data

Jul. 25, 1996 [NL] Netherlands ..... 1003679

[51] Int. Cl.[6] ..... G03G 21/00

[52] U.S. Cl. ..... 399/400; 399/401; 399/364; 399/309

[58] Field of Search ..... 399/309, 302, 399/320, 321, 331, 364, 374, 400, 401

[56] References Cited

U.S. PATENT DOCUMENTS

| | | |
|---|---|---|
| 4,162,847 | 7/1979 | Brandon . |
| 4,392,739 | 7/1983 | Brown et al. . |
| 4,429,987 | 2/1984 | Chang et al. . |
| 4,464,985 | 8/1984 | Asanuma et al. . |
| 4,488,801 | 12/1984 | Gibson . |
| 4,722,064 | 1/1988 | Suzuki . |
| 4,959,693 | 9/1990 | Mitsuya et al. . |
| 5,023,667 | 6/1991 | Negoro et al. . |
| 5,122,973 | 6/1992 | Venner et al. . |
| 5,132,739 | 7/1992 | Mauer et al. . |
| 5,436,711 | 7/1995 | Hauser . |

FOREIGN PATENT DOCUMENTS

0310209B1 1/1986 European Pat. Off. .

*Primary Examiner*—R. L. Moses

*Attorney, Agent, or Firm*—Birch, Stewart, Kolasch & Birch, LLP

[57] ABSTRACT

A printing apparatus prints toner powder images on both sides of an image receiving support (e.g. paper). The apparatus includes an image recording medium for forming a toner powder image thereon; a transfer device for transferring a toner powder image from the image recording medium to the image receiving support; and fixing devices for fixing a transferred toner powder image on the image receiving support by pressure surfaces coming into contact with both sides of the image receiving support. The apparatus further includes image receiving support transport devices for transporting an image receiving support provided with a toner powder image on a first side back to the transfer device for transferring a toner powder image to a second side of the image receiving support. The printing apparatus also includes: adjustable image receiving support transport devices for transporting the image receiving support by transport surfaces coming into contact with the image receiving support, wherein the adjustable image receiving support transport devices, as considered in the image receiving support transport direction, are disposed immediately after the fixing devices. The apparatus employs a shifting device for adjusting the fixing devices and the adjustable image receiving support transport devices in a first and second mode where the pressure surfaces come into contact and out of contact with the image receiving support.

17 Claims, 3 Drawing Sheets

| FIG. 1A | FIG. 1B |
|---|---|

PRINTING APPARATUS FOR PRINTING TONER POWDER IMAGES ON BOTH SIDES OF AN IMAGE RECEIVING SUPPORT

BACKGROUND OF THE INVENTION

1. Field of the Invention

The invention relates to a printing apparatus for printing toner powder images on both sides of an image receiving support (e.g. paper). An image recording medium is provided for forming a toner powder image thereon. A transfer member is provided for transferring a toner powder image from the image recording medium to the image receiving support. A fixing member fixes a transferred toner powder image on the image receiving support by using pressure surfaces coming into contact with both sides of the image receiving support. Image receiving support transport members are provided for transporting an image receiving support provided with a toner powder image on a first side back to the transfer member for transferring a toner powder image to a second side of the image receiving support.

2. Description of Background Art

A printing apparatus is disclosed in U.S. Pat. No. 4,488,801, wherein a printer is provided with an inverting path for duplex prints. In this case, a charged image is formed on a photoconductor by locally discharging the charged photoconductor by means of exposure by a laser in accordance with the image information for reproduction. Toner powder is then brought into contact with the photoconductor via magnetic rollers. Remaining toner powder adheres to the non-discharged parts of the photoconductor. By means of a voltage difference between a transfer corona wire and the photoconductor, the toner power adhering to the photoconductor is transferred to a first side of a paper sheet passing therebetween. The toner powder lying loosely on the paper is then fixed thereon by passing the paper sheet between two fixing rollers and wherein the toner powder is pressed thereon by means of fixing rollers disposed on either side of the paper. The paper sheet is then inverted in a duplex path and returned to the transfer corona. A second image developed on the photoconductor can then be transferred to the second side of the paper sheet. The toner powder on the second side is then fixed on the paper sheet by passing the paper sheet between the fixing rollers again.

One of the problems arising with two-sided fixing rollers of this kind is that the pressure exerted during fixing, and also the temperature rise in the case of heated fixing means, results in contamination of the printing apparatus by toner residues originating from the image receiving support or contaminants originating from the image receiving support itself, e.g. glue, wax or paper fibers. The contaminants released on first fixing of the image receiving support are fed, for example, to the image recording medium by the image receiving support itself, via the image receiving support transport path. In these conditions, it is not only the image receiving support transport means that are soiled but also the image forming means, with the result of reduced efficiency and increases malfunctions. Particularly in the case of re-used image receiving supports or pre-printed image receiving supports, there is a considerable risk of such contamination. Another possible source of soiling is release liquid. To prevent the paper sheet from sticking to a fixing roll, release liquid is frequently used on the fixing roll. U.S. Pat. No. 5,132,739, for example, describes a color printer in which this is the case. Here color toner powder images formed on an endless photoconductor in the form of a belt are transferred successively to and collected on a paper sheet which is tensioned round a drum. When the color separation images have been transferred to one side of the paper sheet, the sheet is inverted in a duplex path and returned to the drum where it is re-tensioned with the still unprinted side facing the photoconductor. The second side of the paper sheet is then correspondingly also provided with color separation images. The duplex path contains a fixing roller with a pressure roller for fixing the toner on the paper sheet. In this case, a uniform layer of oily release liquid is transferred to the heated fixing roller by means of a porous feed roller bearing against the same and saturated with release liquid.

Such release liquid is now gradually deposited on the various paper sheet transport rollers so that ultimately they operate less satisfactorily. Alternatively, as in the color printing apparatus according to the above patent, the drum on which the paper sheet is tensioned is soiled. This drum can in turn come into direct contact with the photoconductor which is pressed against the drum by a biasing roller. As a result, the photoconductor can also be contaminated, and this again results in artefacts in an image for development, such as, for example, a striped background.

The prior art cited in the latter patent describes various steps for minimizing the quantity of release liquid to be applied. In a first embodiment cited, this is effected by releasing the feed roller from the fixing roller in order to prevent excessive build-up of release liquid on the fixing roller. Alternatively, in a second embodiment cited, the amount of release liquid is adapted to the type of image receiving support. In the case of a transparent sheet, less release liquid should be used than in the case of a paper sheet.

In either case, however, there will always be a residual specific quantity, even if minimal, of release liquid resulting in soiling.

In the color printing apparatus as described in the latter patent, in the case of duplex printing of a paper sheet, no release liquid is supplied during a first pass of the paper sheet and this is achieved by moving away from the fixing roller the feed roller supplying the release liquid. Release liquid is again applied only on the second pass of the paper sheet by pressing the feed roller against the fixing roller. It is assumed in these conditions that sufficient release liquid is present on the fixing roller during the first pass to provide proper operation.

These known steps, however, are based on minimizing the amount of release liquid with all the risk of reduced efficiency of the fixing means as a result of too small a working area thereof. A slight disturbance can then result in paper sheets sticking to the fixing means.

In addition, there is still the soiling from substances originating from the image receiving support itself.

The object of the printing apparatus according to the invention is to obviate the disadvantage of soiling of the system without disturbing the proper operation of the fixing means.

To this end, the printing apparatus comprises: adjustable image receiving support transport means for transporting the image receiving support by means of transport surfaces coming into contact with the image receiving support, wherein the adjustable image receiving support transport means, as considered in the image receiving support transport direction, are disposed immediately after the fixing means; shifting means for adjusting the fixing means and the adjustable image receiving support transport means to a first and second mode, wherein in the first mode the adjustable image receiving support transport means are operative and transport the image receiving support wherein the transport surfaces come into contact with the image receiving support and the fixing means are inoperative and the pressure surfaces thereof do not come into contact with the image receiving support, in the second mode the fixing means are operative and fix and transport the image receiving support wherein the pressure surfaces come into contact with the image receiving support and the adjustable image receiving support transport means are inoperative and the transport surfaces thereof do not come into contact with the image receiving support; and the shifting means adjusts for the first and the second modes respectively on the first and second pass respectively of the image receiving support to be fixed on two sides by the fixing means.

The adjustable image receiving support transport means disposed after the fixing means provides the transport of the image receiving support if the fixing means do not. Since the pressure surfaces do not come into contact with the image receiving support during the first passage thereof, no release liquid or other contaminants released during fixing can be entrained with the image receiving support and enter into the system. On the second pass, when the fixing means are operative and come into contact with the image receiving support, the transport surfaces do not come into contact with the image receiving support. Consequently, the latter cannot be soiled by release liquid or other contaminants released during fixing. After the second pass, the image receiving support will not again pass through the duplex path but will be fed to a collecting tray. The duplex paths will then not be soiled with the release liquid applied in the second pass or by other contaminants originating from the image receiving support.

In an improved embodiment, the fixing means are provided with movable image receiving support guide means which in the first and second modes respectively are disposed respectively between and outside the pressure surfaces of the fixing means. As a result, the image receiving support is prevented from coming into contact with the fixing means during the first pass.

In another embodiment, the image receiving support guide means are constructed as two parallel guide plates which extend over the entire pressure surfaces. The image receiving support can be fed between the two guide plates so that when the guide plates are disposed between the two pressure surfaces, the image receiving support transport path is shielded therefrom.

In one embodiment, the fixing means are constructed as an adjustable pair of fixing rollers whose rollers respectively touch and are separated from one another in the first and second modes respectively. It is a simple matter to embody the opening and closing of a roller pair physically, while a roller pair can also provide for the transport of the image receiving support.

In another embodiment, the adjustable image receiving support transport means are constructed as an adjustable transport roller pair whose rollers respectively touch and are separated from one another in the first and second modes respectively. This is more difficult to embody with image receiving support transport means in belt form.

A reliable image receiving support transport is obtained in a construction in which the apparatus further comprises in addition to the adjustable image receiving support transport means: second and third image receiving support transport means disposed successively in the image receiving support transport direction, wherein the second image receiving support transport means are disposed in front of the fixing means and at a distance of less than one image receiving support transit dimension from the adjustable image receiving support transport means and the third image receiving support transport means are disposed after the fixing means at a distance of less than one image receiving support transit dimension from the fixing means. When the fixing means are inoperative, the image receiving support is thus always in contact with at least one image receiving support transport means and transport is guaranteed.

If the adjustable image receiving support transport means and the fixing means are both constructed as pairs of rollers, a practical and rugged construction is obtained if the shifting means comprise pivotable frames wherein each shaft end of a fixing roller is connected by a pivotable frame to a corresponding shaft end of a transport roller of the adjustable transport roller pair. The pivot point of each frame is formed by the shaft of the corresponding transport roller, and the shafts of the transport rollers are movable with respect to one another. In the first mode, the adjustable transport rollers are in contact with one another by contact-pressure means and in the second mode the frames are so pivotable that the fixing rollers together form a fulcrum for the frames so that the transport rollers are separated from one another against the action of the contact-pressure means.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a diagram of a printing apparatus according to the invention with a duplex path containing a fixing and image receiving support transport assembly for duplex printing of image receiving supports, wherein FIG. 1A shows the image forming and the duplex path.

DETAILED DESCRIPTION OF THE PREFERRED EMBODIMENTS

Figures 1, 1A:
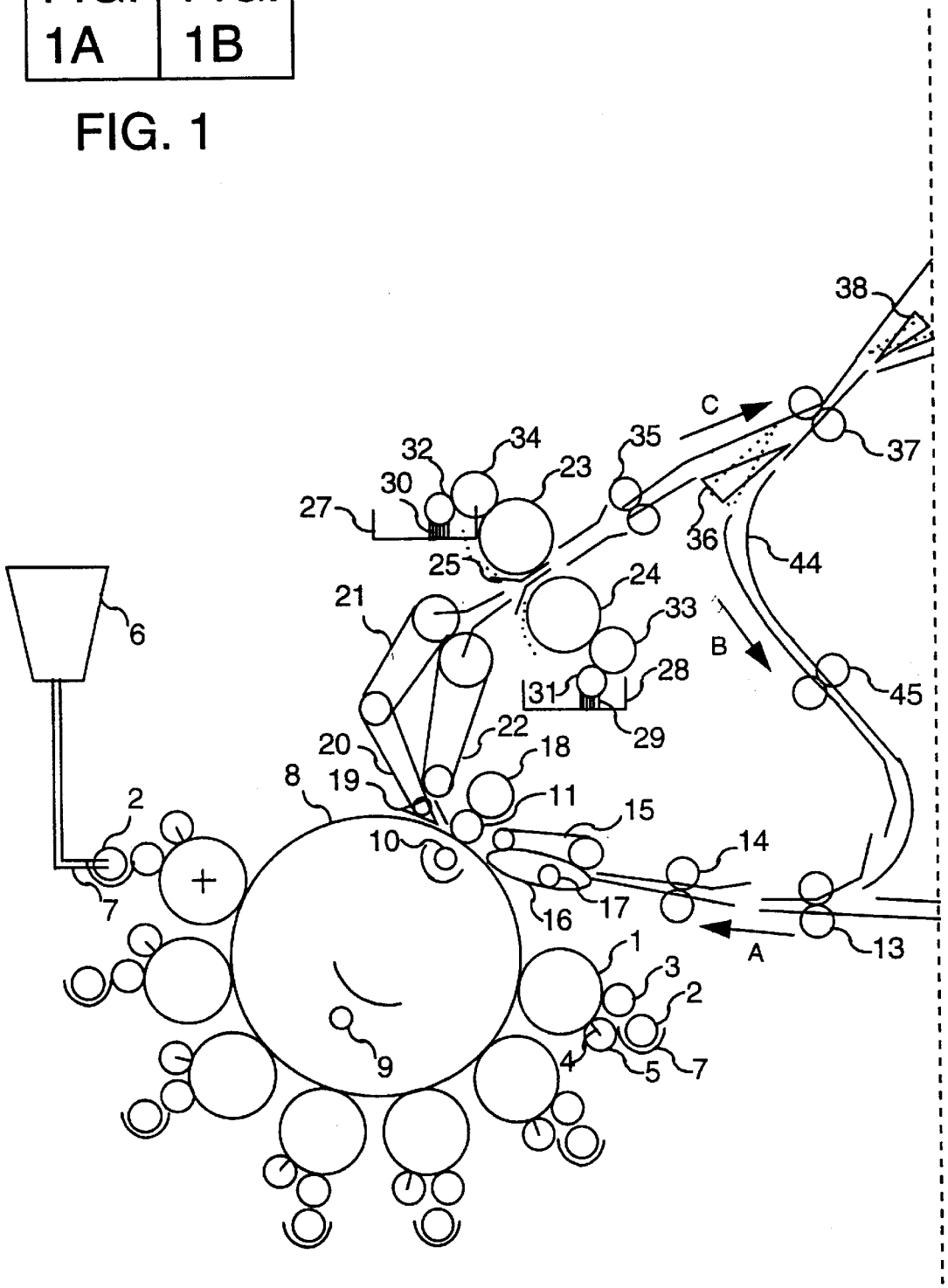

FIG. 1 shows a number of image recording media 1, a toner powder image of a specific color being developed on each image recording medium 1. Since this is a full-color printing apparatus, the toner colors are black, red, green, blue, cyan, magenta and yellow. The image recording medium 1 is in the form of a rotating cylinder having a dielectric surface layer thereon (not shown), with adjacent electrode tracks extending in the direction of rotation beneath said layer. A feed mill 2 and a magnetic feed roller 3 continuously deposit a full surface of electrically conductive and magnetically attractable toner powder on the image recording medium 1 as a result of a continuous voltage difference between the feed roller 3 and the electrodes of the image recording medium 1. The dielectric layer will be charged and the toner thus retained thereon for some time. Normally, this toner will be removed from the image recording medium 1 by a predominant magnetic force produced by a magnetic blade 4 disposed axially with respect to the rotating image recording medium 1. In these conditions a sleeve 5 rotating in the opposite direction with respect to the image recording medium 1 moves around the magnetic blade 4. If an extra voltage is now applied to an electrode, it is possible locally to retain toner on the image recording medium 1 at an intersection of the magnetic blade 4 and such an electrode under extra voltage, as a result of the locally and instantaneously predominating electric force. This principle of toner powder image development is described in European patent application EP 0 310 209.

In this case, the toner is supplied from a toner powder supply reservoir 6 to a toner powder tray 7 disposed beneath the feed mill 2.

However, the invention is not limited to a printing apparatus with this method of image forming. Any image forming operation using toner powder which finally has to be fixed by pressure and heat on the image receiving support, such as a paper sheet, can be considered. For example, an image recording medium in the form of a photoconductor with a laser or LED illumination in combination with an insulating binary toner can also be used in combination with the invention.

In addition, image forming is not restricted to a multicolor image forming operation, although glossing by fixing and the use of a release liquid play a greater part in the case of color.

The toner powder images formed on the separate image recording media 1 are then transferred in alignment to a rotatable central collecting member 8. This collecting member 8 is provided with a surface layer which retains toner powder better than the surface layer of the image forming members 1. By pressing the image recording media 1 against the collecting member 8 with a specific contact pressure, the toner powder is then transferred by pressure transfer to the collecting member 8. In these conditions the collecting member 8 is kept by heat radiators 9 and 10 at a temperature such that some softening of the toner powder takes place, thus further improving adhesion to the collecting member 8.

The toner powder images collected on the collecting member 8 are finally transferred again by pressure transfer and a pressure roller 11 to an image receiving support, e.g. a sheet of paper, passing between said pressure roller 11 and the collecting member 8. The pressure roller 11 is cleaned by a cleaner 18. It should be noted that the collecting member 8 is also cleaned by cleaning means (not shown).

Nor does the invention require toner powder transfer by pressure transfer, although with pressure transfer there is a greater risk of further transfer, to the image recording media 1 themselves, of release liquid used in the fixing agents or contaminants originating from the image receiving support. Other constructions are obtained, for example, with electric transfer, e.g. by means of a corona, in which case toner powder is transferred to the image receiving support without the collecting member coming into contact with the image receiving support. Similarly, the collecting member 8 can be omitted and the toner powder be transferred directly from the image recording medium 1 to the image receiving support. In this case, a cylindrical drum similar to the collecting member 8 can be used in order temporarily to tension the image receiving support.

Of course, with electric transfer the need for fixing means is even greater than in the case of pressure transfer in which some fixing of toner powder on the image receiving support is already obtained.

FIG. 1A shows the direction A from which the image receiving support is supplied to the pressure roller 11. The image receiving support can originate from storage magazines 12 shown in FIG. 2B in the case of the printing of a first side, or from a supply from the image receiving support transport path from direction B in the case of the printing of a second side of an image receiving support for printing on both sides. The following description will refer to the situation when the image receiving support is to be provided with toner powder on both sides.

The image receiving support is then first supplied from a selected storage magazine 12. Pairs of transport rollers 13 and 14 transport the image receiving support on to a preheating station comprising a belt conveyor 15, a guide plate 16 and heating means 17. After a first side has been provided with toner powder by the pressure roller 11, the image receiving support is then fed to heated fixing rollers 23 and 24, inter alia by means of sheet separating means 19, via belt transport means 20, 21 and 22. The fixing rollers 23 and 24 are shown in the first inoperative mode, in which they are separated and isolated from the image receiving support by adjustable image receiving support guide means 25 and 26 shown in a first mode by a continuous line. Said guide means 25 and 26 are in the form of guide plates extending over the entire axial distance of the fixing rollers 23 and 24. This first mode is operative when the image receiving support is passed between the fixing means 23 and 24 for the first time in the case of duplex printing.

The fixing rollers 23 and 24 are provided with a suitable release liquid e.g. a silicone oil, in order to prevent adhesion of the image receiving support to the fixing rollers 23 and 24. The release liquid is supplied from reservoirs 27 and 28 from which the release liquid is sucked up by means of wicks 29 and 30 of suitable porous support material. The release liquid is distributed uniformly and in metered condition over the fixing rollers 23 and 24 by means of metering rollers 31 and 32 and feed rollers 33 and 34.

Thus in the first mode, the toner powder applied to the first side of the image receiving support is not yet fixed. As a result, no release liquid can yet reach the image receiving support nor other contaminating matter be released from the image receiving support.

The image receiving support is transported by the belt transport means 21 and 22 to a pair of transport rollers 35 which, as considered in the direction of transport C of the image receiving support, is disposed immediately after fixing rollers 23 and 24 within an image receiving support transit dimension of the belt transport means 21 and 22. This guarantees transport of the image receiving support in the situation in which the fixing rollers 23 and 24 are separate from one another.

Figure 1B:
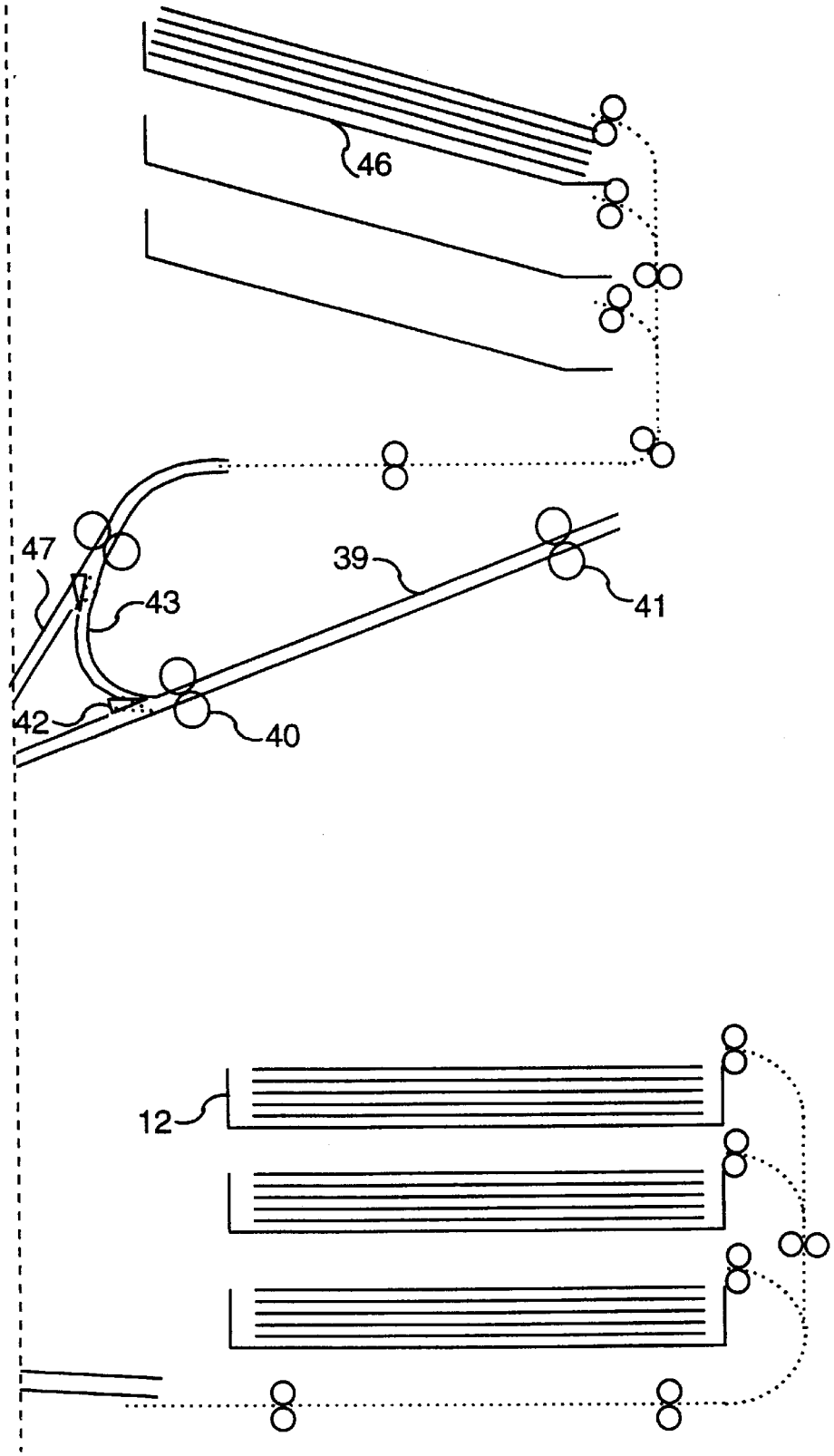
FIG. 1B shows the supply and discharge of image receiving supports.

With the deflector 36 in the position illustrated, the image receiving support is then transported to an inverting path 39 shown in FIG. 1B via the transport roller pair 37 and with the deflector 38 in the broken-line position. The inverting path 39 is provided with transport roller pairs 40 and 41 which transport the image receiving support in the opposite direction over the same path when the image receiving support has passed the deflector 38. In the position illustrated, the deflector 42 disposed in the inverting path 39 shuts off the part of the transport path denoted by reference 43. On the return transport of the image receiving support, the deflector 36 is brought into the broken-line position, so that the image receiving support is fed to part 44 of the transport path. The image receiving support is now again fed to the pressure roller 11 via the transport roller pair 45, with the second side of the support facing the collecting member 8. Here the second side is then provided with a toner powder image by the pressure roller 11.

The image receiving support now printed on two sides is then again fed to the fixing rollers 23 and 24 via the belt transport means 20, 21 and 22. In contrast to the first passage, the fixing rollers 23 and 24 are now brought into an operative position in which they press against one another with a certain contact pressure force. In this case the image receiving support guide means 25 and 26 are brought into a second broken-line position so that they are no longer situated between the fixing rollers 23 and 24. The pressure exerted by the fixing rollers on the image receiving support fed between them finally provides better adhesion of the toner powder on the receiving support and better coverage of the image receiving support by the toner powder. As already stated, the fixing rollers 23 and 24 are in addition also internally heated, thus enhancing the fixing effect.

During this second pass, the transport roller pair 35 is also brought into an inoperative position by separating the rollers thereof. These rollers then no longer come into contact with the image receiving support passing therebetween and accordingly cannot be soiled by release liquid applied to the image receiving support during fixing or by material released from the image receiving support during fixing. The image receiving support transport function of the transport roller pair 35 is now taken over by the fixing rollers 23 and 24 themselves. The distance between the fixing rollers 23 and 24 and the next operative transport rollers 37 is therefore no greater than an image receiving support dimension in the transit direction.

These positions of the fixing rollers 23 and 24, image receiving support guide means 25 and 26 and transport roller pair 35 form the second mode after the first mode mentioned hereinbefore.

The image receiving support must then be collected in the collecting trays 46 shown in FIG. 1B. The first printed side of the image receiving support must face downwards in these conditions. To this end, the image receiving support originating from the fixing rollers 23 and 24 is fed to the inverting path 39 via the deflector 38 in the broken-line position, and past the deflector 42 to invert the image receiving support. With the deflector 42 in the broken-line position, the image receiving support is then fed back in the opposite direction by the transport rollers 40 and 41 and then transported to the collecting trays 46 via the part 43 of the image receiving support transport path.

Of course, in the case of an image receiving support to be printed on only one side, the fixing means are operative in the first and also the only pass and hence stay in the first mode. To collect the printed side facing downwards in the collecting tray 46, the image receiving support is then fed thereto immediately via the part 47 of the image receiving support transport path. In this case the deflector 38 is in the position shown by the continuous line and the deflector 47 is in the broken-line position.

It should also be noted that on a second pass of the image receiving support printed on both sides the transport rollers 37, 40 and 41 situated further away from the fixing means do come into contact with the image receiving support provided with release liquid. However, in practice this has proved to have a less contaminating influence on the system than in the case of soiling of the transport roller pair 35 disposed immediately after the fixing rollers 23 and 24. Soiling of the other system parts, e.g. the collecting medium 8, has then been found to be very limited. The reason for this is the cooling of the image receiving support which occurs after passage through heated fixing rollers so that the release liquid thereon adheres better to the image receiving support itself. The release of substances from the image receiving support itself also decreases with the cooling that occurs. By lifting the transport roller pair 35 a sufficiently long transport path is obtained for this cooling.

It should also be noted that the steps according to the invention besides being applicable to other forms of image forming and image collection can also be applied to another construction of the image receiving support transport path itself. The essential feature is the co-operation of the fixing rollers 23 and 24 and the transport roller pair 35 disposed thereafter, in the two modes.

Figure 2:
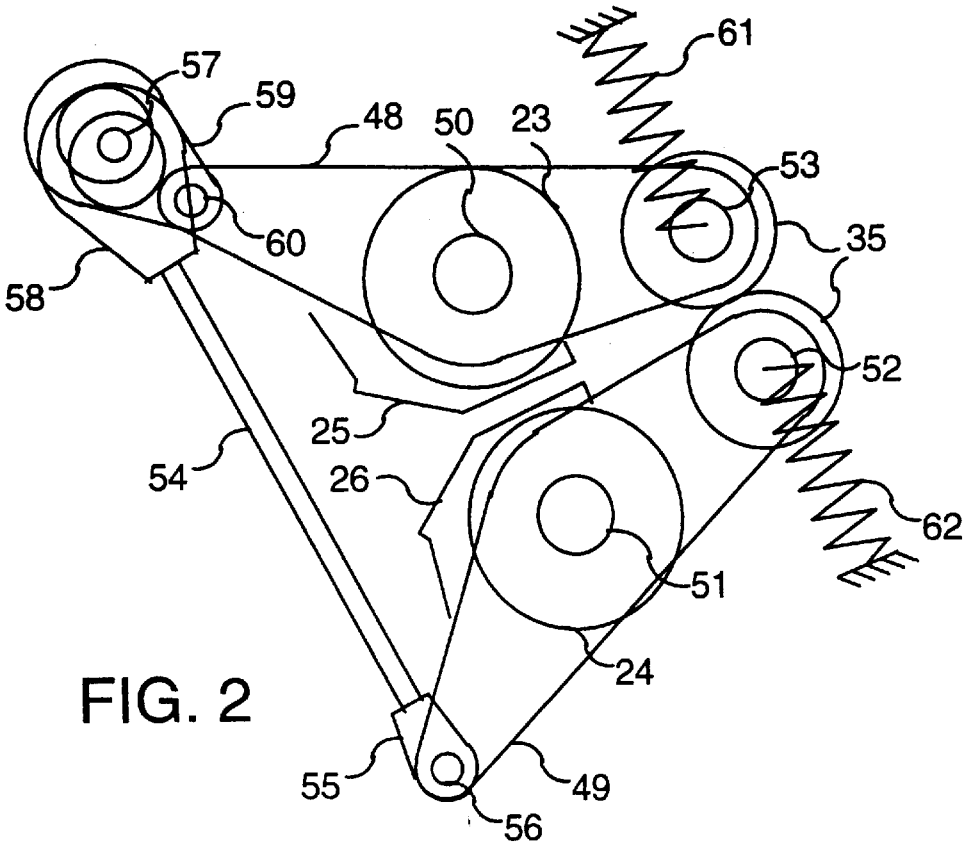
FIG. 2 shows an embodiment of a fixing and image receiving support transport assembly of the printing apparatus according to FIG. 1 operative in a first mode.
Figure 3:
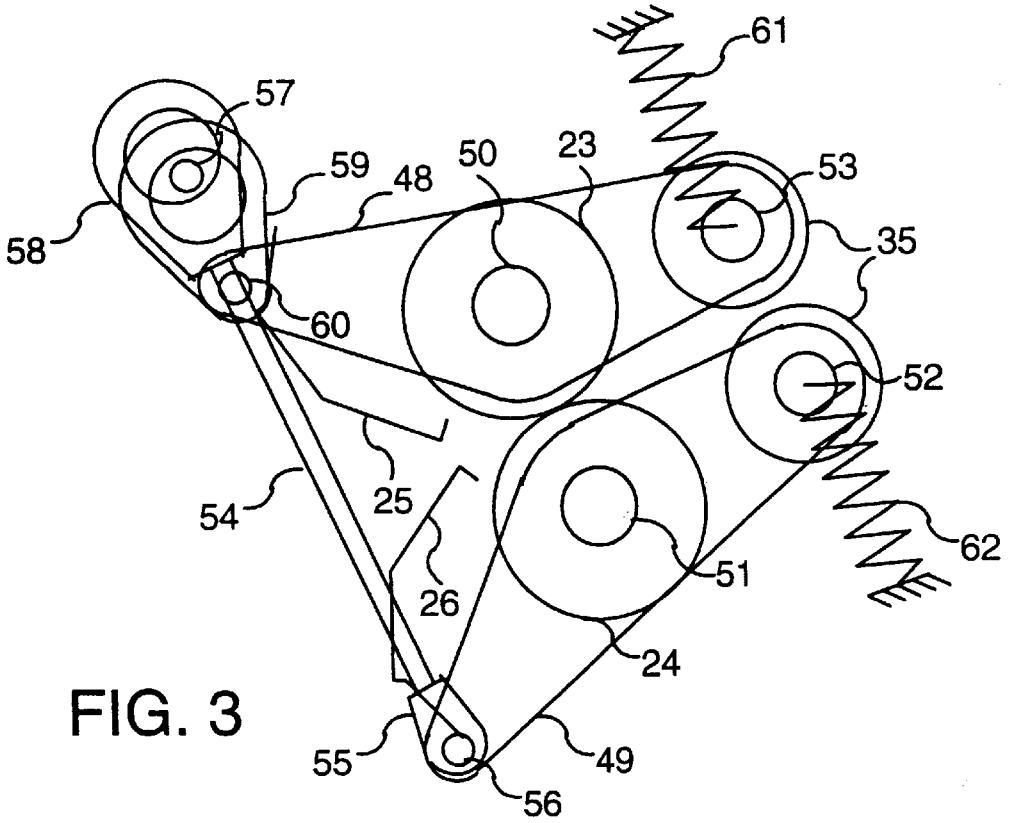
FIG. 3 shows an embodiment of a fixing and image receiving support transport assembly of the printing apparatus according to FIG. 1 operative in a second mode.

One advantageous embodiment in which the said co-operation of the fixing rollers 23 and 24 with the transport roller pair 35 is obtained is shown in FIGS. 2 and 3.

FIG. 2 shows a first mode with the fixing rollers 23 and 24 in the inoperative position and the transport roller pair 35 in the operative position. The image receiving support guide plates 25 and 26 are also in this mode for a considerable proportion between the fixing rollers 23 and 24. In this case the image receiving support guide plates 25 and 26 extend over the entire axial direction of the fixing rollers 23 and 24. The shifting mechanism in order to obtain the first mode and the second mode shown in FIG. 3 is illustrated in FIGS. 2 and 3 in respect of one side of the fixing rollers 23 and 24 and the transport roller assembly 35. The part illustrated comprises frames 48 and 49 in which shaft ends of the fixing rollers 23 and 24 and the transport roller assembly 35 are suspended. In this case the frame 48 connects the shaft end 50 of the fixing roller 23 to the shaft end 53 of the one roller of the assembly 3 situated on the same side. The frame 49 connects the shaft end 51 of the fixing roller 24 to the shaft end 52 of the other roller of the assembly 52. The shifting mechanism also comprises a coupling rod 54 by means of which one end is pivotally connected via a first connecting member 55 to a shaft 56 connected to the frame 49 and the other end is connected via a second connecting member 58 for eccentric pivoting to a movable cam 57. The frame 48 is also coupled by a connecting member 59, which is pivotally coupled by one end to the frame 48, via a shaft 60 and by the other end is connected for eccentric pivoting to the cam 57.

As a result of the movement of the cam 57 and via the eccentric operation of the connecting members 58 and 59, those ends where the shafts 60 and 56 of the frames 48 and 49 are situated either move apart as in the first mode shown in FIG. 2, or towards one another as in the second mode shown in FIG. 3.

In the case of FIG. 2, the transport roller assembly 35 operates in the first mode as a fulcrum for the two frames 48 and 49. It should be noted that the rollers of the assembly 35 are made from deformable material and can to some extent be pressed in. When the fixing rollers 23 and 24 are separated, the rollers of the assembly 35 are pressed on to one another by spring means 61 and 62.

In the case of FIG. 3, the fixing rollers 23 and 24 in the second mode function as a fulcrum for the frames 48 and 49 and the rollers of the assembly 35 are lifted against the action of the spring means 35. Here again it should be noted that the fixing rollers 23 and 24 can be pressed in to some extent.

The advantage of the coupling described is that synchronization of the opening and closing of the fixing rollers 23 and 24 is reliably and simply coupled to the opening and closing of the rollers of the transport roller pair 35.

It should also be noted that the presence of the guide plates 25 and 26 is not of itself a requirement for the operation of the invention, although it does mean an improvement thereof.

Finally it should be noted that with regard to copy quality it is advantageous to fix the duplex printed image receiving support in one operation simultaneously on both sides during the last pass. In the case of fixing already being carried out during a first pass or in the case of fixing means which can fix on only one side, there will also be a change of the properties of the image receiving support apart from release liquid contamination. This in turn influences transfer of toner powder from an image recording medium or an image collecting member to the second side so that the copy quality differs on the two sides.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A printing apparatus for printing toner powder images on both sides of an image receiving support comprising:

an image recording medium for forming a toner powder image thereon;

transfer means for transferring a toner powder image from the image recording medium to the image receiving support;

fixing means for fixing a transferred toner powder image on the image receiving support by means of pressure surfaces coming into contact with both sides of the image receiving support;

image receiving support transport means for transporting an image receiving support provided with a toner powder image on a first side back to the transfer means for transferring a toner powder image to a second side of the image receiving support;

adjustable image receiving support transport means for transporting the image receiving support by means of transport surfaces coming into contact with the image receiving support, wherein the adjustable image receiving support transport means, as considered in the image receiving support transport direction, are disposed immediately after the fixing means; and shifting means for adjusting the fixing means and the adjustable image receiving support transport means to a first and second mode, wherein in the first mode the adjustable image receiving support transport means are operative and transport the image receiving support wherein the transport surfaces come into contact with the image receiving support and the fixing means are inoperative and the pressure surfaces thereof do not come into contact with the image receiving support, in the second mode the fixing means are operative and fix and transport the image receiving support wherein the pressure surfaces come into contact with the image receiving support and the adjustable image receiving support transport means are inoperative and the transport surfaces thereof do not come into contact with the image receiving support, the shifting means adjusts the first and the second modes respectively on the first and second pass respectively of the image receiving support to be fixed on two sides by the fixing means.

2. The printing apparatus according to claim 1, wherein the fixing means are provided with movable image receiving support guide means which in the first and second modes respectively are disposed respectively between and not between the pressure surfaces of the fixing means.

3. The printing apparatus according to claim 2, wherein the image receiving support guide means are constructed as two guide plates which extend over the entire pressure surfaces.

4. The printing apparatus according to claim 1, wherein the fixing means are constructed as an adjustable pair of fixing rollers whose rollers respectively touch and are separated from one another in the first and second modes respectively.

5. The printing apparatus according to claim 1, wherein the adjustable image receiving support transport means are constructed as an adjustable transport roller pair whose rollers respectively touch and are separated from one another in the first and second modes respectively.

6. The printing apparatus according to claim 1, wherein the apparatus further comprises:

second and third image receiving support transport means disposed successively in the image receiving support transport direction, wherein the second image receiving support transport means are disposed in front of the fixing means and at a distance of less than one image receiving support transit dimension from the adjustable image receiving support transport means and the third image receiving support transport means are disposed after the fixing means at a distance of less than one image receiving support transit dimension from the fixing means.

7. The printing apparatus according to claim 4, wherein the shifting means comprises pivotable frames wherein each shaft end of a fixing roller is connected by a pivotable frame to a corresponding shaft end of a transport roller of the adjustable transport roller pair, the pivot point of each frame is formed by the shaft of the corresponding transport roller, the shafts of the transport rollers are movable with respect to one another wherein in the first mode the adjustable transport rollers are in contact with one another by contact-pressure means and in the second mode the frames are so pivotable that the fixing rollers together form a fulcrum for the frames so that the transport rollers are separated from one another against the action of the contact-pressure means.

8. The printing apparatus according to claim 2, wherein the fixing means are constructed as an adjustable pair of fixing rollers whose rollers respectively touch and are separated from one another in the first and second modes respectively.

9. The printing apparatus according to claim 3, wherein the fixing means are constructed as an adjustable pair of fixing rollers whose rollers respectively touch and are separated from one another in the first and second modes respectively.

10. The printing apparatus according to claim 2, wherein the adjustable image receiving support transport means are constructed as an adjustable transport roller pair whose rollers respectively touch and are separated from one another in the first and second modes respectively.

11. The printing apparatus according to claim 3, wherein the adjustable image receiving support transport means are constructed as an adjustable transport roller pair whose rollers respectively touch and are separated from one another in the first and second modes respectively.

12. The printing apparatus according to claim 4, wherein the adjustable image receiving support transport means are constructed as an adjustable transport roller pair whose rollers respectively touch and are separated from one another in the first and second modes respectively.

13. The printing apparatus according to claim 2, wherein the apparatus further comprises:

second and third image receiving support transport means disposed successively in the image receiving support transport direction, wherein the second image receiving support transport means are disposed in front of the fixing means and at a distance of less than one image receiving support transit dimension from the adjustable image receiving support transport means and the third image receiving support transport means are disposed after the fixing means at a distance of less than one image receiving support transit dimension from the fixing means.

14. The printing apparatus according to claim 3, wherein the apparatus further comprises:

second and third image receiving support transport means disposed successively in the image receiving support transport direction, wherein the second image receiving support transport means are disposed in front of the fixing means and at a distance of less than one image receiving support transit dimension from the adjustable image receiving support transport means and the third image receiving support transport means are disposed after the fixing means at a distance of less than one image receiving support transit dimension from the fixing means.

15. The printing apparatus according to claim 4, wherein the apparatus further comprises:

second and third image receiving support transport means disposed successively in the image receiving support transport direction, wherein the second image receiving support transport means are disposed in front of the fixing means and at a distance of less than one image receiving support transit dimension from the adjustable image receiving support transport means and the third image receiving support transport means are disposed after the fixing means at a distance of less than one image receiving support transit dimension from the fixing means.

16. The printing apparatus according to claim 5, wherein the apparatus further comprises:

second and third image receiving support transport means disposed successively in the image receiving support transport direction, wherein the second image receiving support transport means are disposed in front of the fixing means and at a distance of less than one image receiving support transit dimension from the adjustable image receiving support transport means and the third image receiving support transport means are disposed after the fixing means at a distance of less than one image receiving support transit dimension from the fixing means.

17. The printing apparatus according to claim 5, wherein the shifting means comprises pivotable frames wherein each shaft end of a fixing roller is connected by a pivotable frame to a corresponding shaft end of a transport roller of the adjustable transport roller pair, the pivot point of each frame is formed by the shaft of the corresponding transport roller, the shafts of the transport rollers are movable with respect to one another wherein in the first mode the adjustable transport rollers are in contact with one another by contact-pressure means and in the second mode the frames are so pivotable that the fixing rollers together form a fulcrum for the frames so that the transport rollers are separated from one another against the action of the contact-pressure means.

* * * * *